US008261408B2

(12) United States Patent
Oberhaensli et al.

(10) Patent No.: US 8,261,408 B2
(45) **Date of Patent: *Sep. 11, 2012**

(54) SQUEEGEE ASSEMBLY FOR A FLOOR CLEANING MACHINE

(75) Inventors: Franz Oberhaensli, Mosnang (CH); Heinrich-Tito Mayer, Eschlikon (CH)

(73) Assignee: Diversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/109,140

(22) Filed: May 17, 2011

(65) Prior Publication Data

US 2011/0214692 A1 Sep. 8, 2011

Related U.S. Application Data

(63) Continuation of application No. 12/158,522, filed as application No. PCT/US2006/060961 on Nov. 16, 2006, now Pat. No. 7,950,106.

(60) Provisional application No. 60/753,287, filed on Dec. 22, 2005.

(51) Int. Cl.
*A47L 13/11* (2006.01)

(52) U.S. Cl. ..... 15/401; 15/320; 15/245

(58) Field of Classification Search ..... 15/401, 15/402, 245, 245.1, 117, 121, 320
See application file for complete search history.

(56) References Cited

U.S. PATENT DOCUMENTS

| | | | |
|---|---|---|---|
| 851,173 | A | 4/1907 | Keys |
| 3,290,716 | A | 12/1966 | Cain |
| 3,496,591 | A | 2/1970 | Sheler |
| 4,339,841 | A | 7/1982 | Waldhaser et al. |
| D296,317 | S | 6/1988 | Mower et al. |
| 5,212,848 | A | 5/1993 | Geyer |
| 5,377,382 | A | 1/1995 | Bores et al. |
| 5,455,985 | A | 10/1995 | Hamline et al. |
| 5,517,717 | A | 5/1996 | Haberli |

(Continued)

FOREIGN PATENT DOCUMENTS

| | | |
|---|---|---|
| DE | 19719495 | 11/1997 |

(Continued)

OTHER PUBLICATIONS

International Search Report prepared by the European Patent Office—Date of Mailing Jun. 7, 2007.

*Primary Examiner* — Dung Van Nguyen
(74) *Attorney, Agent, or Firm* — Michael Best & Friedrich LLP

(57) ABSTRACT

A squeegee assembly for removing liquids from a floor. The squeegee assembly includes a frame that has a first and second suction ports separated from each other in a lateral direction, and a squeegee blade coupled to the frame and positioned adjacent the suction ports. The squeegee blade has a first portion adjacent the first suction port, and a second portion adjacent the second suction port. The first portion extends in lateral directions away from the first suction port at an angle to channel fluid encountered by the first portion toward the first suction port. The second portion extends in lateral directions away from the second suction port at an angle to channel fluid encountered by the second portion toward the second suction port such that the squeegee blade acts as a separate funnel for each of the first suction port and the second suction port.

20 Claims, 18 Drawing Sheets

U.S. PATENT DOCUMENTS

| | | | | |
|---|---|---|---|---|
| 5,579,555 | A | 12/1996 | Pearse | |
| D380,434 | S | 7/1997 | Chen | |
| D380,435 | S | 7/1997 | Chen | |
| D388,568 | S | 12/1997 | Leonard et al. | |
| 6,088,871 | A | 7/2000 | Kobayashi | |
| 6,243,911 | B1 | 6/2001 | Varner | |
| 6,427,285 | B1 | 8/2002 | Legatt et al. | |
| D490,763 | S | 6/2004 | Kim | |
| 6,895,633 | B2 | 5/2005 | Tucker | |
| 6,896,742 | B2 | 5/2005 | Geyer et al. | |
| 7,950,106 | B2 * | 5/2011 | Oberhaensli et al. | 15/401 |
| 2002/0050023 | A1 | 5/2002 | Stuchlik | |
| 2004/0031115 | A1 | 2/2004 | Gavney, Jr. | |
| 2004/0261207 | A1 | 12/2004 | Gavney, Jr. | |
| 2005/0115015 | A1 | 6/2005 | Legatt et al. | |

FOREIGN PATENT DOCUMENTS

| | | |
|---|---|---|
| DE | 20109267 | 9/2001 |
| DE | 20112322 | 10/2001 |
| EP | 0338773 | 10/1989 |
| EP | 0569430 | 11/1993 |
| EP | 0662301 | 7/1995 |
| FR | 2762503 | 10/1998 |
| GB | 1175831 | 12/1969 |
| GB | 2408446 | 6/2005 |
| JP | 206263 | 8/1997 |
| WO | 96/25872 | 8/1996 |
| WO | 97/21378 | 6/1997 |
| WO | 9721378 | 6/1997 |

* cited by examiner

SQUEEGEE ASSEMBLY FOR A FLOOR CLEANING MACHINE

CROSS-REFERENCE TO RELATED APPLICATIONS

This is a continuation of U.S. patent application Ser. No. 12/158,522 filed on Oct. 21, 2008, which claims priority to PCT Patent App. No. PCT/US2006/060961 filed on Nov. 16, 2006, which claims priority to U.S. Provisional Patent App. No. 60/753,287 filed on Dec. 22, 2005. Priority is hereby claimed to these prior patent applications, the entire contents of which are incorporated herein by reference.

BACKGROUND OF THE INVENTION

Cleaning machines utilize scrubbing units for cleaning floor surfaces. The scrubbing unit typically includes a number of brushes that are located at the front of the cleaning machine. After the cleaning step involving the scrubbing brushes, it is desirable to wipe up liquid that remains on the surface, as well as remove the imprint of cleaning machine wheel tracks. These operations are commonly performed by a squeegee assembly that is located at the back of the cleaning machine. The squeegee assembly can be raised and lowered relative to the body or main frame of the cleaning machine using a linking unit.

Straight, V-shaped, or arced squeegee assemblies, such as is shown in FIG. 1, are conventionally used to remove liquid from the floor. The squeegee assembly includes squeegee blades that engage the floor surface in a wiping action to assist in picking up liquid on the floor. The V-shape and arc shape generally do a better job at removing liquid from the floor because their shape drives fluid from the outer extents of the squeegee assembly toward the center where suction is applied to remove the liquid from the floor. In a straight squeegee assembly, the suction has to perform much of the work to draw liquid from the outer extents of the squeegee assembly. Even with the improved performance of the V-shaped squeegee and the arced squeegee, improved performance can be achieved.

It is common for the squeegee blades to wear out as a result of their use in wiping against the floor surface. It becomes necessary therefore to replace the blades that are used in picking up the liquid. In order to connect squeegee blades to a squeegee assembly, it is common to use a number of connectors that are disposed perpendicular to the lengths of the squeegee blades. This process of changing squeegee blades can be cumbersome.

SUMMARY OF THE INVENTION

The present invention relates to an improved squeegee assembly. Some embodiments of the present invention are directed to a uniquely shaped squeegee configuration that has been found to remove liquids from a floor in an efficient manner. Other embodiments are directed to a squeegee fixation device. Yet other embodiments are directed toward a squeegee orientation device. Some embodiments are also directed toward a lifting mechanism and the connection between the squeegee assembly and the lifting mechanism.

Some embodiments of the present invention provide a squeegee assembly for removing liquids from a floor, wherein the squeegee assembly is adapted for use with a floor cleaning machine. The squeegee assembly of some embodiments comprises a frame having a center point and a first and a second suction port positioned on opposite sides of the frame relative to the center point. The squeegee assembly also includes a leading squeegee blade coupled to the frame and positioned in front of the suction ports relative to a cleaning direction of travel of the squeegee assembly. The leading squeegee blade has a first portion having a generally concave shape relative to the cleaning direction of travel of the squeegee assembly. The first portion of the leading squeegee blade is positioned adjacent the first suction port. The leading squeegee blade also has a second portion having a generally concave shape relative to the cleaning direction of travel of the squeegee assembly. The second portion of the leading squeegee blade is positioned adjacent the second suction port. The first and second portions of the leading squeegee blade meet in a generally convex shape relative to the cleaning direction of travel. In some embodiments, the squeegee assembly further includes a trailing squeegee blade coupled to the frame and positioned behind the suction ports relative to a cleaning direction of travel of the squeegee assembly. The trailing squeegee blade can be similarly shaped to the leading squeegee blade. In some embodiments, the distance between the first portion of the leading squeegee blade and the first portion of the trailing squeegee blade substantially continuously reduces extending away from the first suction port, and the distance between the second portion of the leading squeegee blade and the second portion of the trailing squeegee blade substantially continuously reduces extending away from the second suction port.

One embodiment is directed toward a squeegee assembly having a frame movable in a direction of travel and having a width extending laterally relative to the direction of travel. The frame has a first and a second suction port separated from each other laterally. The squeegee assembly also has a leading squeegee blade coupled to the frame and positioned in front of the suction ports relative to direction of travel. The leading squeegee blade has a first portion positioned adjacent the first suction port, wherein the first portion extends in both lateral directions away from the first suction port in an inclined manner relative to the direction of travel and the lateral direction such that the area of the first portion immediately adjacent first suction port is positioned furthest rearward in the direction of travel relative to the remainder of the first portion. The leading squeegee blade has a second portion positioned adjacent the second suction port, wherein the second portion extends in both lateral directions away from the second suction port in an inclined manner relative to the direction of travel and the lateral direction such that the area of the second portion immediately adjacent second suction port is positioned furthest rearward in the direction of travel relative to the remainder of the second portion. As described above, the first and second portions of the leading squeegee blade can be described as generally concave shaped. Further, in some embodiments, the first and second portion of the leading squeegee blade meet in a generally convex shape relative to the direction of travel. The squeegee assembly of this embodiment can also include a trailing squeegee blade coupled to the frame and positioned behind the suction ports relative to the direction of travel. The trailing squeegee blade can have a shape substantially similar to the shape of the leading squeegee blade. Accordingly, the trailing squeegee blade can have a first portion positioned adjacent the first suction port, wherein the first portion extends in both lateral directions away from the first suction port in an inclined manner relative to the direction of travel and the lateral direction such that the area of the first portion immediately adjacent first suction port is positioned furthest rearward in the direction of travel relative to the remainder of the first portion of the trailing squeegee blade. The trailing squeegee blade also has a second portion positioned adjacent the second suction port, wherein the second portion extends in both lateral directions away from the second suction port in an inclined manner relative to the direction of travel and the lateral direction such that the area of the second portion immediately adjacent second suction port is positioned furthest rearward in the direction of travel relative to the remainder of the second portion of the trailing squeegee blade. As described above, the first and second portions of the trailing squeegee blade can be described as generally concave shaped. Further, the first and second portion of the trailing squeegee blade can meet in a generally convex shape relative to the direction of travel. Like the previous embodiment, the distance between the first portion of the leading squeegee blade and the first portion of the trailing squeegee blade can substantially continuously reduce as the blades extend away from the first suction port in both lateral directions relative to the first suction port. Further, the distance between the second portion of the leading squeegee blade and the second portion of the trailing squeegee blade can substantially continuously reduce as the blades extend away from the second suction port in both lateral directions relative to the first suction port.

Some embodiments are directed toward a squeegee assembly having a frame movable in a direction of travel and having a width extending laterally relative to the direction of travel. The frame also has a first and a second suction port separated from each other laterally. The squeegee assembly includes a trailing squeegee blade coupled to the frame and positioned behind the suction ports relative to the direction of travel. The trailing squeegee blade has a first portion positioned adjacent the first suction port. The first portion extends in both lateral directions away from the first suction port in an inclined manner relative to the direction of travel and the lateral direction such that the area of the first portion immediately adjacent first suction port is positioned furthest rearward in the direction of travel relative to the remainder of the first portion of the trailing squeegee blade. The trailing squeegee blade has a second portion positioned adjacent the second suction port. The second portion extends in both lateral directions away from the second suction port in an inclined manner relative to the direction of travel and the lateral direction such that the area of the second portion immediately adjacent second suction port is positioned furthest rearward in the direction of travel relative to the remainder of the second portion of the trailing squeegee blade. As described above, the first and second portion of the trailing squeegee blade can be considered to be generally concave shaped. Furthermore, in some embodiments, the first and second portions of the trailing squeegee blade meet in a generally convex shape relative to the direction of travel.

Another embodiment relates to a squeegee assembly having a frame movable in a direction of travel and having a first and a second suction port separated from each other in a lateral direction. The squeegee assembly includes a squeegee blade coupled to the frame and positioned adjacent the suction ports relative to the direction of travel, wherein the squeegee blade has a first portion positioned adjacent the first suction port and a second portion positioned adjacent the second suction port. The first portion extending in both lateral directions away from the first suction port at an angle to channel substantially all fluid encountered by the first portion toward the first suction port. The second portion extending in both lateral directions away from the second suction port at an angle to channel substantially all fluid encountered by the second portion toward the second suction port.

Some embodiments are directed toward a squeegee assembly including a frame movable in a direction of travel and having a first and a second suction port separated from each other in a lateral direction. The squeegee assembly also includes a W-shaped squeegee blade coupled to the frame. The W-shaped squeegee blade has a substantially centrally located forwardly directed apex and two laterally located rearwardly directed apexes positioned on either side of the forwardly directed apex. Each of the first and second suction ports are positioned adjacent one of the rearwardly directed apexes.

One embodiment is directed toward a squeegee assembly including a frame movable in a direction of travel and having a first and a second suction port separated from each other in a lateral direction. The squeegee assembly includes a W-shaped squeegee blade coupled to the frame. The W-shaped squeegee blade has a centrally located forwardly directed wedge and two laterally located rearwardly directed wedges positioned on either side of the forwardly directed wedge. Each of the first and second suction ports are positioned adjacent one of the rearwardly directed wedges.

Another embodiment is directed toward a squeegee assembly having a frame, a squeegee coupled to the frame, and three rollers coupled to the frame. The rollers are adapted to roll along a floor being traversed by the squeegee assembly. The rollers are positioned on the frame to define a plane and support the frame relative to the floor in a predefined orientation. The three rollers at least partially determine the angle of contact between the squeegee and the floor. Each roller has an axis of rotation, and the axis of rotation of each roller does not intersect both of the other two rollers. In some embodiments, the rollers are selectively adjustable relative to the frame to alter the orientation of the frame relative to the floor. In one specific embodiment, the frame has a first and second end and a central area positioned between the first and second end, one roller is positioned adjacent each end and one roller is positioned in the central area.

Yet other embodiments are directed toward a squeegee assembly having a first squeegee blade, a second squeegee blade offset from the first blade, and a frame having a channel for receiving and orienting the first and second squeegee blades. The channel is at least partially defined by a base, a first wall oriented at an angle relative to the base, and a second wall offset from the first wall and oriented at an angle relative to the base. A jam is dimensioned and configured to be received within the channel and pinch the first and second squeegee blades against the first and second walls of the channel. A plurality of fasteners extend between the jam and the channel to couple the jam to the channel. The channel and jam are configured to orient the blades at a non-right angle relative to the frame. In some embodiments, the first and second walls of the channel have a stepped profile. Additionally, the jam can have a stepped profile. More specifically, the edges of the jam have a stepped profile.

Some embodiments relate to a squeegee assembly adapted for use with a floor cleaning machine. The squeegee assembly includes a frame having an aperture and a biased member coupled to the frame and positioned adjacent to the aperture. The biased member is biased toward the aperture. A squeegee blade is also coupled to the frame. A lifting member extends between the machine and the frame and has an end positioned within the aperture. The lifting member has a recess positioned adjacent the end positioned within the aperture. The recess is dimensioned and configured to receive the biased member. The biased member is biased to engage the recess and couple the frame to the lifting member. The biased member is configured to disengage the recess and allows the frame to separate from the lifting member when a predetermined force is applied to the frame. In some embodiments, the frame includes a second aperture and the end of the lifting member has a fork-like configuration including a first fork member and a second fork member. The first and second fork members each are received within one of the apertures of the frame. Each fork member has a recess for receiving the biased member. The biased member, in such an embodiment, is positioned between the apertures of frame and the biased member has two biased elements, wherein one biased element is biased toward each aperture.

Some embodiments are directed toward a method of connecting a squeegee assembly to a floor cleaning machine. The method comprises providing an aperture on the squeegee assemble and a bias member positioned adjacent to the aperture. The bias member is biased toward a position at least partially over the aperture. A lifting member is coupled to the floor cleaning machine and the lifting member has an end receivable into the aperture of the squeegee assembly. The lifting member also has a recess positioned adjacent the end that is inserted into the aperture. The bias member is biased toward the recess on the lifting member and engages the recess to couple the lifting member to the squeegee assembly.

Some embodiments of the present invention are directed toward a method of coupling squeegee blades to a squeegee assembly. The method comprises providing a squeegee assembly frame having a channel defined by a base, a first wall oriented at an angle relative to the base, and a second wall offset from the first wall and oriented at an angle relative to the base. The method further includes inserting a first squeegee blade in the channel, wherein the first squeegee blade has a first side and a second side bounded by top and bottom longitudinal edges and two vertically oriented side edges. The first side of the first squeegee blade is placed against the first wall of the channel and the top longitudinal edge is placed in abutment against the base. A jam dimensioned and configured to be received within the channel is inserted into the channel. The jam contacts the second side of the first squeegee blade and pinches or wedges the first squeegee blade against the first wall of the channel to secure the first squeegee blade to the frame. Fasteners are provided to secure the jam to the frame.

Some embodiments are directed toward a method of orienting a squeegee blade relative to a floor. The method includes providing a frame having a squeegee coupled to the frame and three rollers coupled to the frame, wherein the rollers are non-aligned with each other. The rollers define a plane of support for the frame and squeegee blades. The plane of support provides a predefined orientation for the squeegee blade.

Other embodiments are related to a method of removing a liquid from a floor. The method includes providing a squeegee assembly that orients a squeegee blade in a W-shape and has suction ports at each of the two lower apexes of the W-shape. The squeegee assembly is moved over the floor, which drives liquid encountered by W-shape squeegee toward the two lower apexes of the W-shape. Suction is applied at the two lower apexes of the W-shape to remove the liquid.

Another embodiment relates to a squeegee assembly for removing liquids from a floor. The squeegee assembly includes a frame that has a first and second suction ports separated from each other in a lateral direction, and a squeegee blade coupled to the frame and positioned adjacent the suction ports. The squeegee blade has a first portion adjacent the first suction port, and a second portion adjacent the second suction port. The first portion extends in lateral directions away from the first suction port at an angle to channel fluid encountered by the first portion toward the first suction port. The second portion extends in lateral directions away from the second suction port at an angle to channel fluid encountered by the second portion toward the second suction port such that the squeegee blade acts as a separate funnel for each of the first suction port and the second suction port.

Some embodiments relate to a method of removing a liquid from a floor. In these embodiments, the method includes providing a frame that is movable in a direction of travel and that has a first suction port and a second suction port separated from the first suction port in a lateral direction, and a squeegee blade that is contactable with the floor. The method also includes funneling liquid encountered by the squeegee blade toward the first suction port, and funneling liquid encountered by the squeegee blade toward the second suction port.

Further aspects of the present invention, together with the organization and operation thereof, will become apparent from the following detailed description of the invention when taken in conjunction with the accompanying drawings.

DETAILED DESCRIPTION

Figure 1:
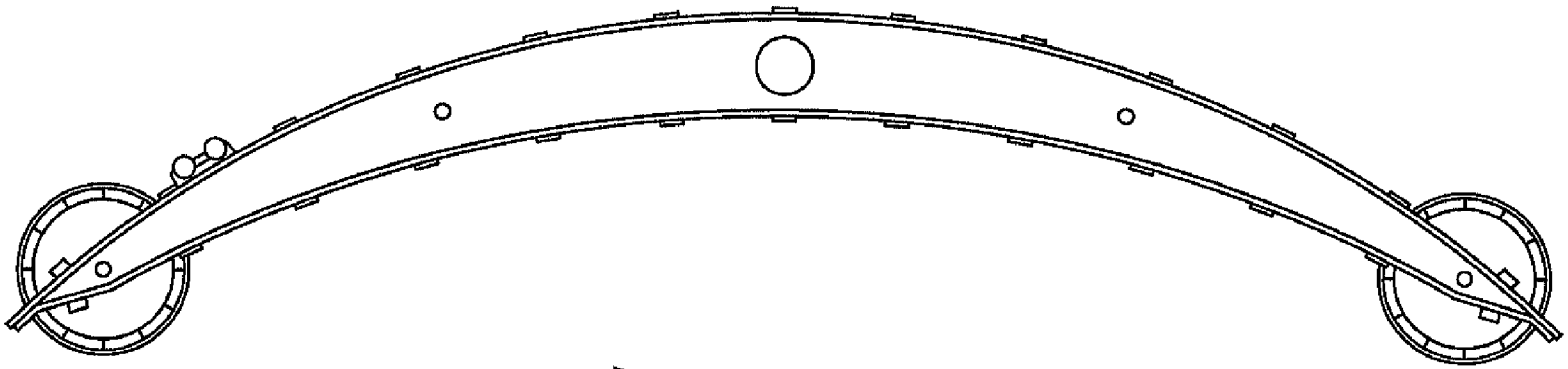
FIG. 1 PRIOR ART
FIG. 1 is a plan view of a conventional, prior art arc shaped squeegee assembly.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

FIGS. 2-20 show at least three separate embodiments of a squeegee assembly 30, wherein the squeegee assembly 30 embodies aspects of the present invention. One embodiment of the squeegee assembly 30 is shown in FIGS. 2-6. Another embodiment of the squeegee assembly 30 is shown in FIGS. 7-13. A third embodiment of the squeegee assembly 30 is shown in FIGS. 14-20. Generally, the construction and function of each of these illustrated embodiments is substantially the same. Accordingly, only the first embodiment will be disclosed in detail. Furthermore, only major deviations from that first embodiment will be described with respect to the other embodiments. As such, common reference numerals between the various embodiments will generally indicate the same or a substantially similar part, area, or assembly.

FIGS. 2-6 show a squeegee assembly 30 for use with a floor cleaning machine. The illustrated squeegee 30 assembly includes a frame 32 having suction ports 34, 35, an attachment device (not shown) to attach the assembly 30 to a floor cleaning machine, one or more squeegee blades 36, 37, a fixation device 38 for fixing the blades 36, 37 to the frame 32, and a set of rollers 40 to orient the squeegee assembly 30 in a predefined plane relative to a floor being traversed by the squeegee assembly 30. Each of these aspects will be discussed in greater detail below. However, not all embodiments of the squeegee assembly 30 must contain each of these features. For example, some embodiments of the squeegee assembly 30 do not need to have rollers 40, the particular fixation device 38, etc. In other words, it should be understood that the illustrated squeegee assembly 30 may contain several patentable features that are independent of the shape, function, construction, and/or configuration of other aspects or components of the squeegee assembly 30.

Figure 26:
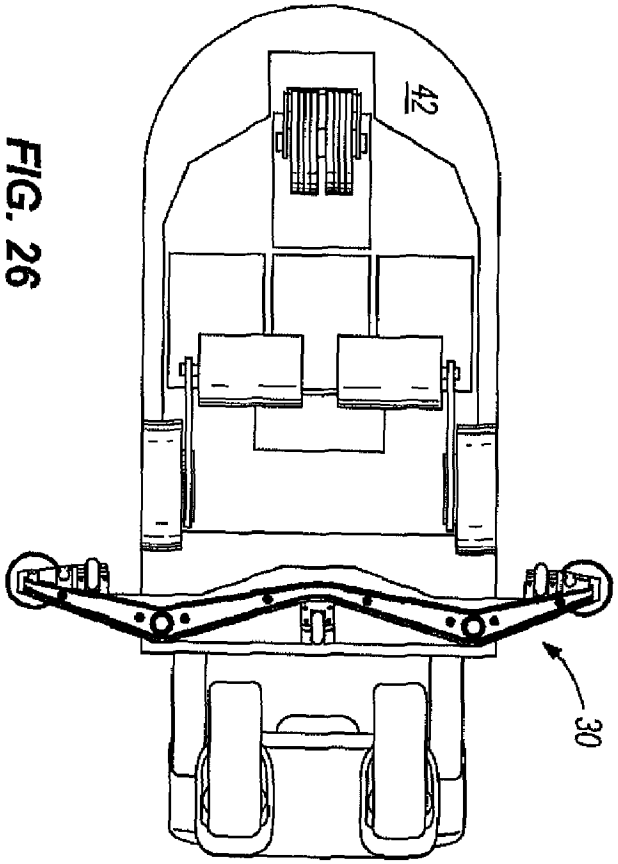
FIG. 26 is a bottom view of the exemplary floor cleaning machine and squeegee assembly shown in FIG. 25.
Figure 27:
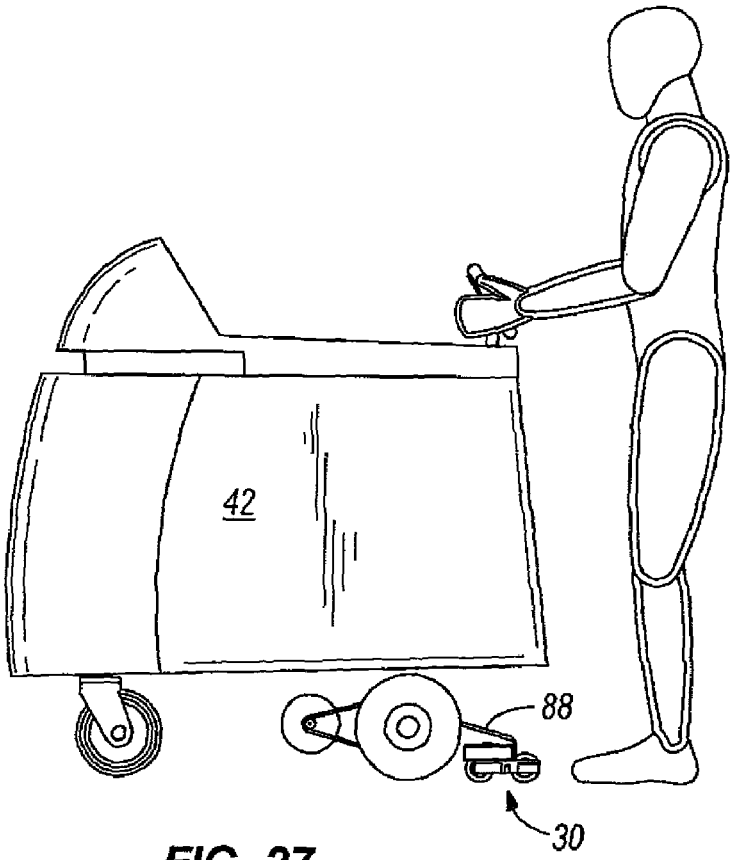
FIG. 27 is a side view of the exemplary floor cleaning machine and squeegee assembly shown in FIG. 25.

The illustrated frame 32 is designed to trial behind or be positioned below a floor cleaning machine 42 (see FIG. 26). The frame 32 has a width W that generally extends at least the width of the floor cleaning machine 42 that it is connected to; however, in some embodiments, such as the one shown in FIG. 26, the width of the frame 32 is larger than the width of the floor cleaning machine 42 to assure that all liquid placed on the floor by the machine is removed. The frame 32 also has a length L that extends substantially in the direction of motion of the floor cleaning machine 42. In other words, the length L is generally normal to the width W.

The illustrated frame 32 has two suction ports 34, 35 that extend through the frame 32. The suction ports 34, 35 are laterally spaced apart. Each suction port is positioned in an off-center configuration, with one port positioned on either side of the center line of the squeegee assembly 30. In the illustrated embodiment, the suctions ports are spaced nearly equidistant on either side of the center line of the frame 32. Furthermore, each suction port is substantially centered along the width of each half of the frame 32. As such, the suction ports 34, 35 are substantially equidistant from each end of the frame 32 relative to each other. However, in other embodiments, the suction ports 34, 35 can be positioned in different locations.

The suction ports 34, 35 are configured to receive or connect to a suction hose or line (not shown) extending from the floor cleaning machine 42. Suction can be applied to the floor through these ports to remove liquids from the floor.

Figure 28:
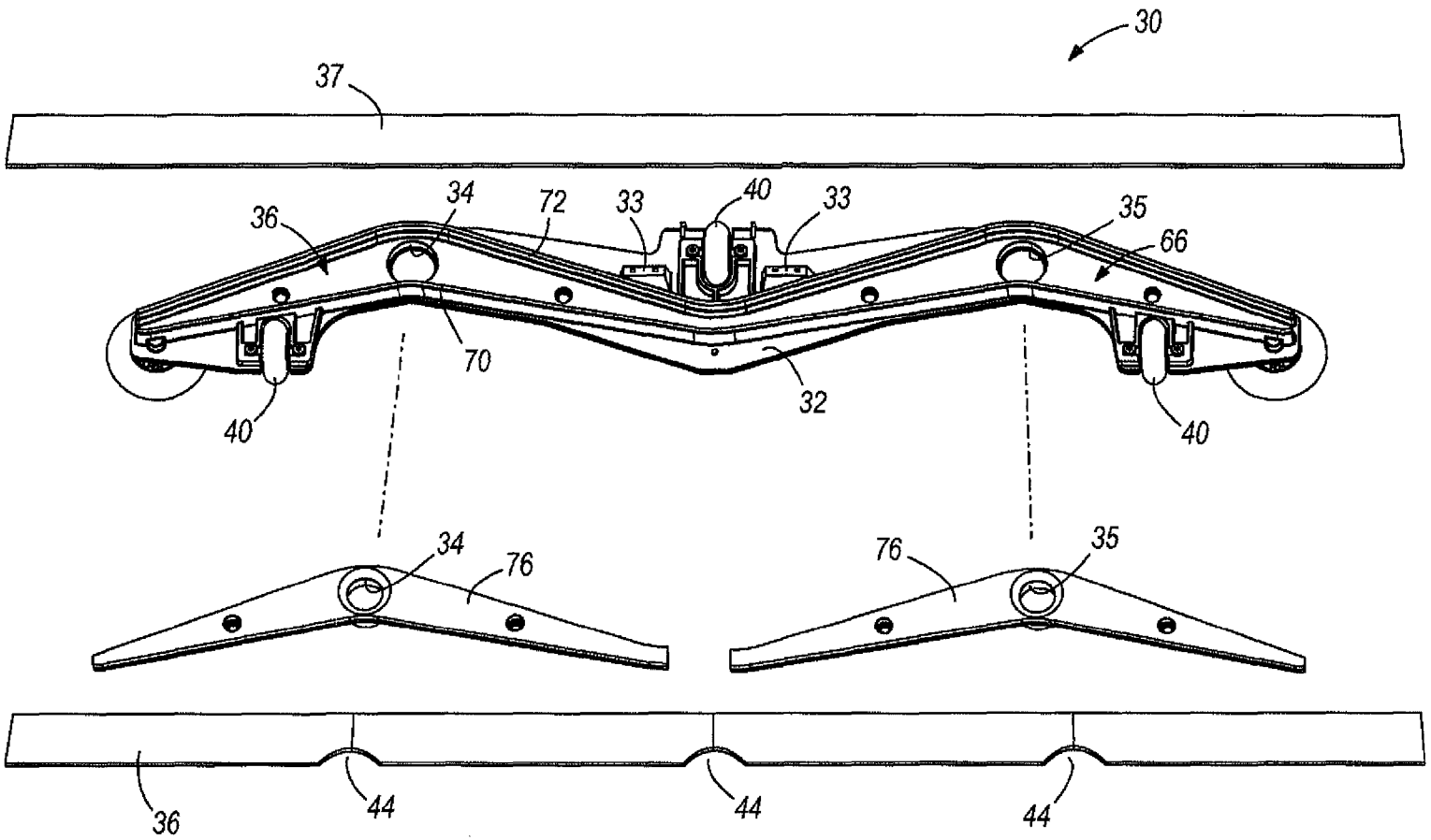
FIG. 28 is a bottom exploded view of a squeegee assembly embodying aspects of the present invention.
Figure 29:
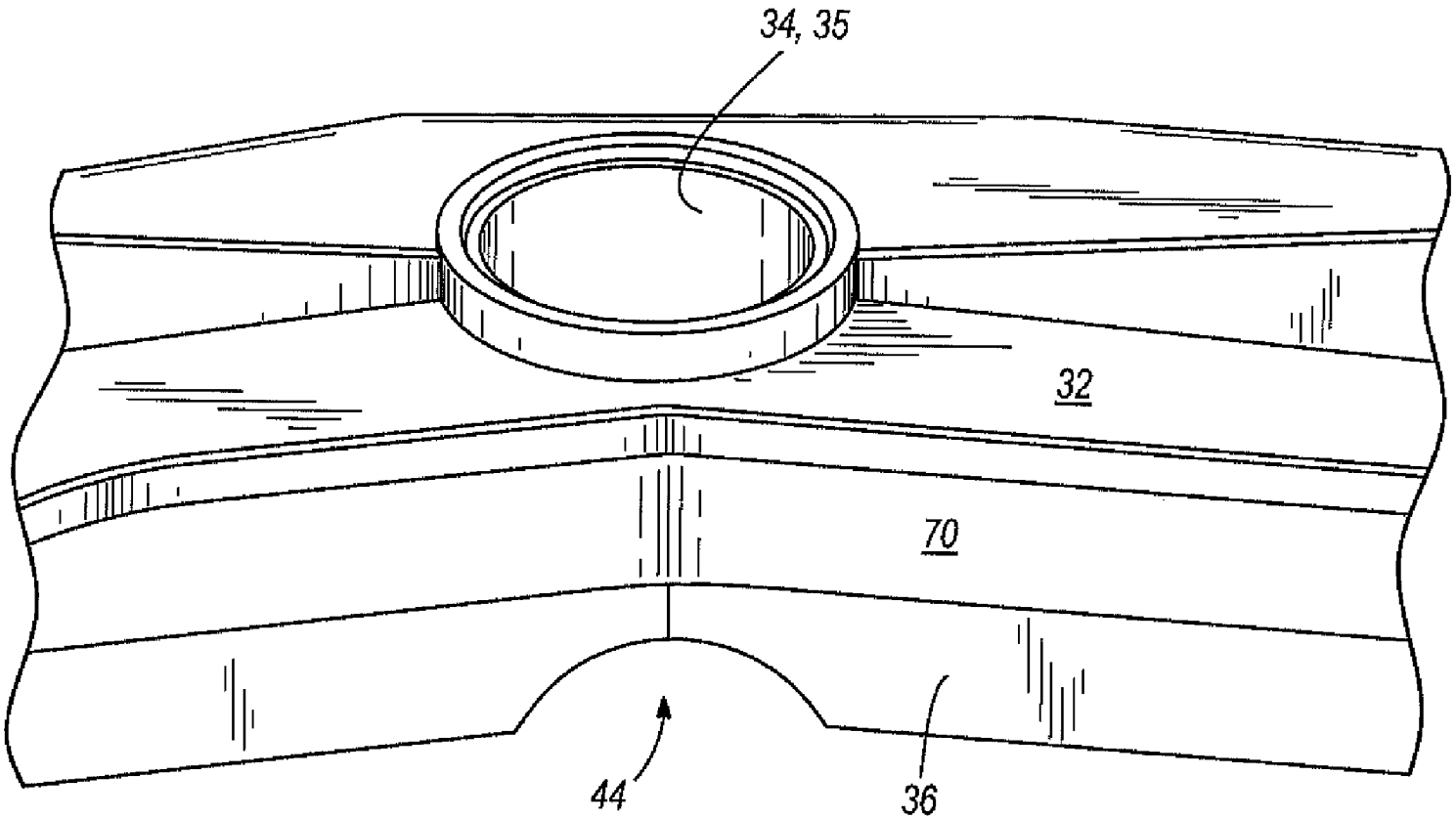
FIG. 29 is a partial front elevation view of a squeegee assembly shown in FIG. 28, showing the leading squeegee blade adjacent a suction port.

As mentioned above, the frame 32 supports one or more squeegee blades 36, 37. In the illustrated embodiment, the frame 32 supports two squeegee blades 36, 37: a leading squeegee blade 36 and a trailing squeegee blade 37 off set from the leading squeegee blade 36. The leading squeegee blade 36 is positioned in front of the trailing squeegee blade 37 relative to the direction of movement of the squeegee assembly 30 (or floor cleaning machine 42) during normal cleaning operations. Further, the leading squeegee blade 36 is positioned in front of the suction ports 34, 35 relative to the direction of travel of the squeegee assembly 30 during normal operation. As shown in FIGS. 28 and 29, recesses, cuts, or other apertures 44 are provided in the leading squeegee blade 36 at the interface with the floor to allow fluid to be channeled behind the leading blade toward the suction ports 34, 35. The trailing squeegee blade 37 is positioned behind the suction ports 34, 35 relative to the direction of travel of the squeegee assembly 30.

In one particular embodiment, the frame 32 supports the squeegee blades 36, 37 in a substantially W-shaped configuration. The W-shaped squeegee blades have a substantially centrally located forwardly directed apex 46 and two laterally located rearwardly directed apexes 48, 50 positioned on either side of the forwardly directed apex 46. Each of the first and second suction ports 34, 35 are positioned adjacent one of the rearwardly directed apexes 48, 50. In other words, the W-shape can be divided into a first V-shaped or concave portion 52 and a second V-shaped or concave portion 54. The apex 48, 50 of each V-shape portion 52, 54 is positioned adjacent the suction ports 34, 35. Yet another way to describe this configuration is as follows. The W-shaped squeegee blade has a substantially centrally located forwardly directed wedge 56 and two laterally located rearwardly directed wedges 58, 60 positioned on either side of the forwardly directed wedge 56. Each of the first and second suction ports 34, 35 are positioned adjacent one of the rearwardly directed wedges 58, 60. This configuration has been found to provide excellent liquid removal capabilities due in part to the fact that the V-shaped configuration drives the fluid toward the suction ports 34, 35 as the squeegee assembly 30 moves along the floor.

In some embodiments, the squeegees 36, 37 can be described has having a first portion 62 and a second portion 64. The first portion can extend in both lateral directions away from the first suction port 34 at an angle or along a curved path to channel substantially all fluid encountered by the first portion toward the first suction port 34. The second portion can extend in both lateral directions away from the second suction port 35 at an angle or along a curved path to channel substantially all fluid encountered by the second portion toward the second suction port 35. The first and second portions 62, 64 of the squeegee are not necessarily V-shaped in all embodiments, but they yet can function in substantially the same manner. For example the first and second portions can both be arc shaped. Accordingly, these portions can be configured and described several ways, such as those that follow, to provide the enhanced function.

Another way of describing the first and second portions 62, 64 of the squeegees 36, 37 is as follows. In some embodiments, the leading squeegee blade 36 has a first portion 62 having a generally concave shape relative to the cleaning direction of travel of the squeegee assembly 30. The first portion 62 of the leading squeegee blade 36 is positioned adjacent the first suction port 34. The leading squeegee blade 36 also has a second portion 64 having a generally concave shape relative to the cleaning direction of travel of the squeegee assembly 30. The second portion 64 of the leading squeegee blade 36 is positioned adjacent the second suction port 35. The first and second portions 62, 64 of the leading squeegee blade 36 meet in a generally convex shape relative to the cleaning direction of travel.

Another way to describe a preferred configuration of the squeegee blades 36, 37 is as follows. The first portion 62 is positioned adjacent the first suction port 34, wherein the first portion 62 extends in both lateral directions away from the first suction port 34 in an inclined manner relative to the direction of travel and the lateral direction such that the area of the first portion 62 immediately adjacent first suction port 34 is positioned furthest rearward in the direction of travel relative to the remainder of the first portion. The second portion 64 is positioned adjacent the second suction port 35, wherein the second portion 64 extends in both lateral directions away from the second suction port 35 in an inclined manner relative to the direction of travel and the lateral direction such that the area of the second portion immediately adjacent second suction port 35 is positioned furthest rearward in the direction of travel relative to the remainder of the second portion 64. As described above, the first and second portions 62, 64 of the squeegee blade 36, 37 can be described as generally concave shaped and/or V-shaped, depending upon the actual path followed by the blade. In such a configuration, as shown in FIG. 2, the first and second portion 62, 64 of the squeegee blade 36, 37 can meet in a generally convex shape relative to the direction of travel.

Figure 2:
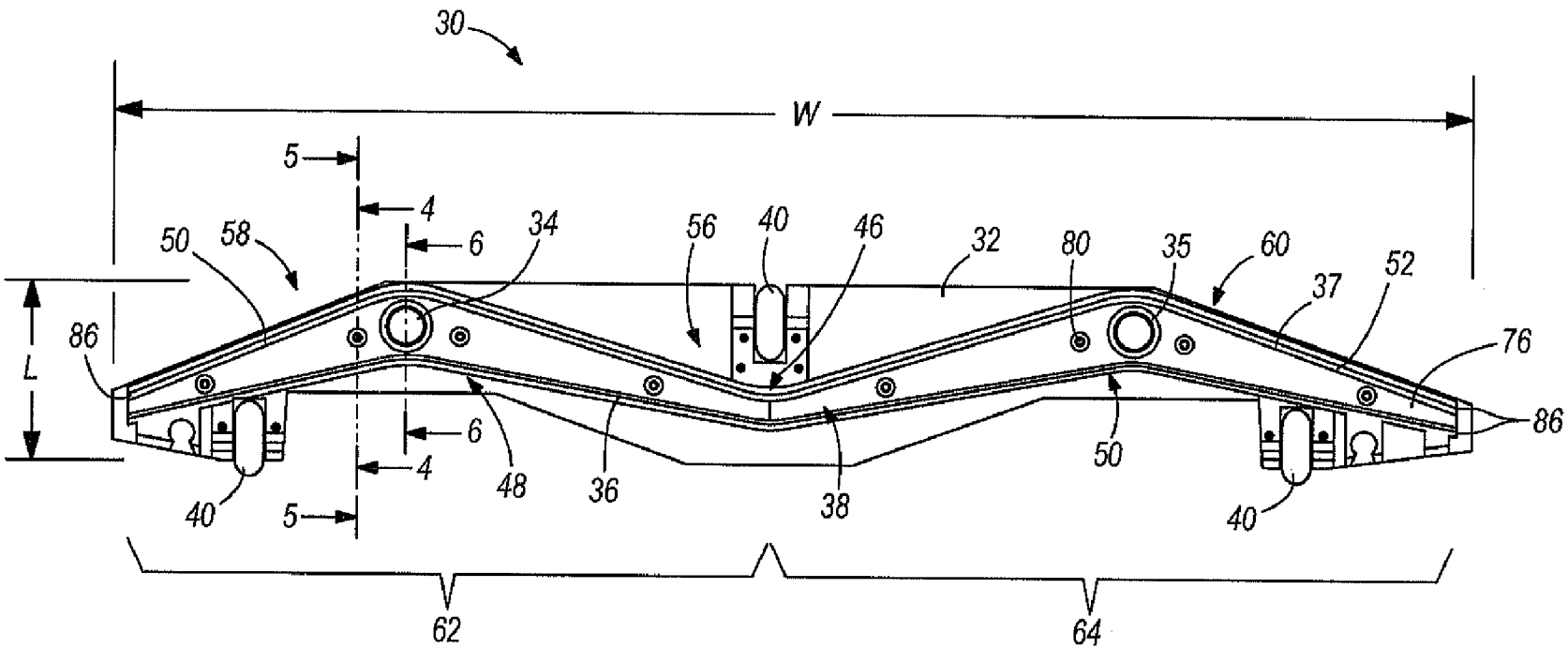
FIG. 2 is a bottom view of a squeegee assembly embodying aspects of the present invention.
Figure 3:
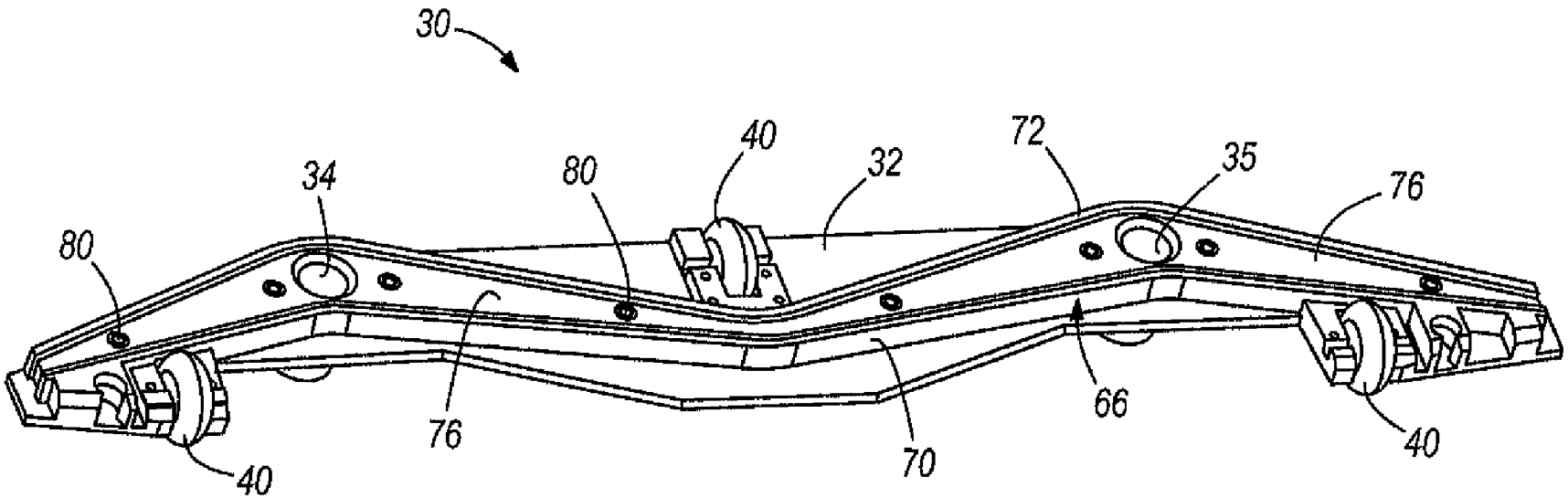
FIG. 3 is a bottom perspective view of the squeegee assembly shown in FIG. 2.

As illustrated in FIG. 2, the leading blade 36 and trailing blade 37 are configured and off set with respect to each other to cause the space between the blades to taper as the blades extend away from the suction ports 34, 35. More specifically, the distance between the first portion 62 of the leading squeegee blade 36 and the first portion 62 of the trailing squeegee blade 37 substantially continuously reduces as the blades extend away from the first suction port 34 in both lateral directions relative to the first suction port 34. Further, the distance between the second portion 64 of the leading squeegee blade 36 and the second portion 64 of the trailing squeegee blade 37 substantially continuously reduces as the blades extend away from the second suction port 35 in both lateral directions relative to the first suction port 34. This configuration aids in providing appropriate suction and liquid removal at the furthest extents of the squeegee assembly 30. The configuration described above can be altered in some embodiments. For example, the distance between the blades 36, 37 can be substantially constant. Furthermore, the two blades can have other configurations relative to each other.

The illustrated embodiment shows two squeegee blades 36, 37 coupled to the frame 32, wherein one squeegee blade is a leading squeegee blade 36 and the other squeegee blade is a trailing squeegee. Not all embodiments, however, may require both squeegee blades 36, 37. Rather, in some embodiments, the squeegee assembly 30 may only need one of the two squeegee blades 36, 37 and not necessarily both. For example, in some embodiments, the squeegee assembly 30 can be provided with a leading squeegee blade 36 only. In such an embodiment, the blade would funnel or drive all liquid toward the suction ports 34, 35, wherein the liquid would be allowed to pass under the squeegee blade. In another example, the squeegee assembly 30 can be provided with only a trailing squeegee blade 37. In such an embodiment, the blade would funnel or drive all liquid contacted by the blade toward each suction port, wherein the liquid would be removed from the floor.

The operation of the illustrated W-shape squeegee assembly 30 works as follows. The squeegee blades 36, 37 are placed in contact with the floor and moved along the floor. The squeegee 36, 37 is oriented and moved such that the upper apex 46 of the W-shape is substantially directed in the direction of movement of the squeegee assembly 30 to form a forwardly facing wedge 46. As such, the two lower apexes 48, 50 of the W-shape point opposite the direction of travel to form rearwardly directed wedges 58, 60 that funnel liquids toward the two lower apexes 48, 50 of the W-shape squeegee as the squeegee assembly 30 passes over the floor. Accordingly, the liquid is directed toward the suction ports 34, 35 to be removed from the floor via suction applied through the suction ports 34, 35.

In some embodiments, the orientation of the squeegee blades 36, 37 or the angle of contact of the squeegee blades 36, 37 relative to floor can substantially effect liquid removal from the floor. The illustrated squeegee assembly 30 utilizes two features that can be employed independently in some embodiments, to properly orient the blades with respect to the floor and assure proper contact of the blades with the floor. One feature is the fixation device 38 that couples the blades to the frame 32 of the squeegee assembly 30. The other feature is roller assembly 40 coupled to the frame 32 orient the frame 32 (and the blade coupled to the frame 32) relative to the floor. Each of these features will be discussed below.

The squeegee blades 36, 37 can be coupled to the frame 32 many different ways. For example, fasteners can directly connect each blade to the frame 32. Further, adhesive can be used to connect the blades to the frame 32. Although the blade can be coupled to the frame 32 many different ways, FIGS. 2-5 illustrate one particular way of coupling the blades 36, 37 to the frame 32, which is believed to provide advantages relative to other coupling techniques.

Figure 4:
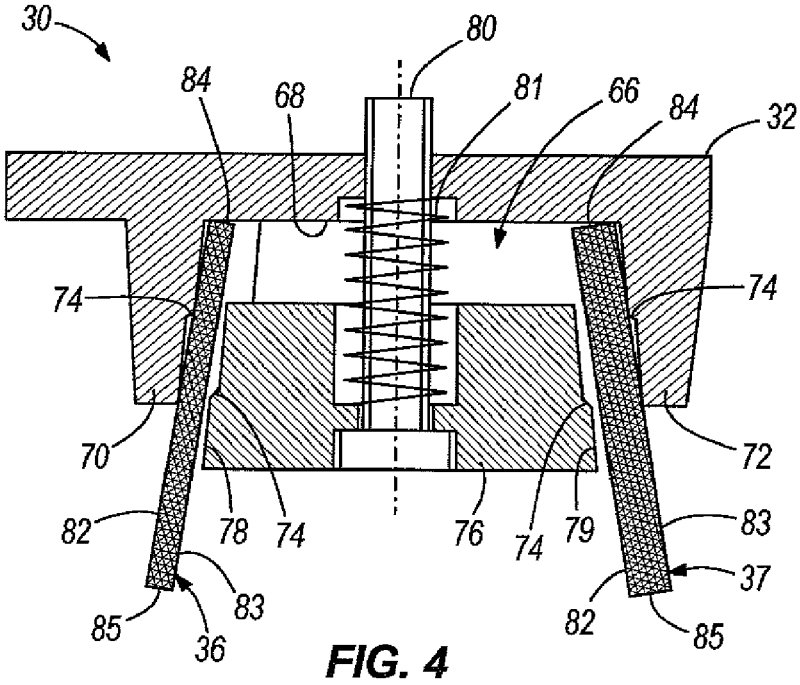
FIG. 4 is a cross-sectional view of the squeegee assembly shown in FIG. 2, taken along line 4-4.
Figure 5:
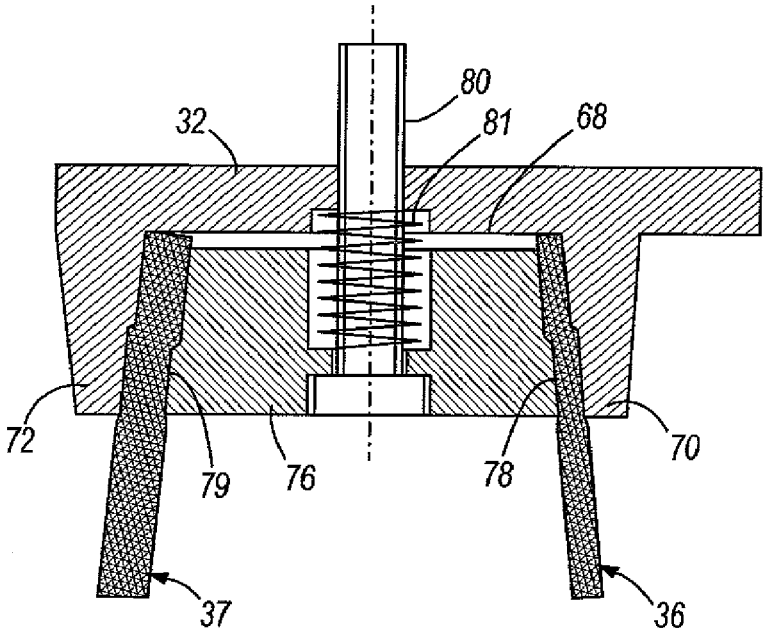
FIG. 5 is a cross-sectional view of the squeegee assembly shown in FIG. 2, taken along line 5-5.
Figure 6:
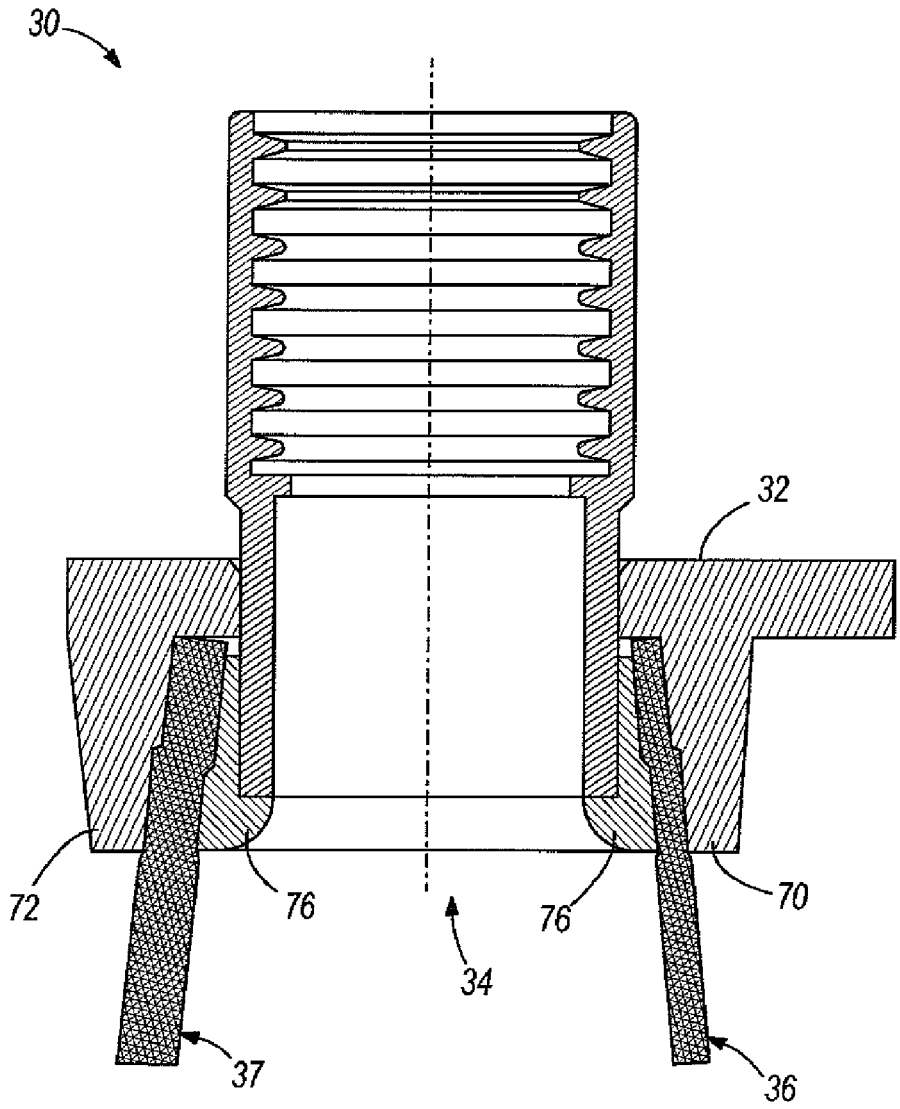
FIG. 6 is a cross-sectional view of the squeegee assembly shown in FIG. 2, taken along line 6-6.
Figure 7:
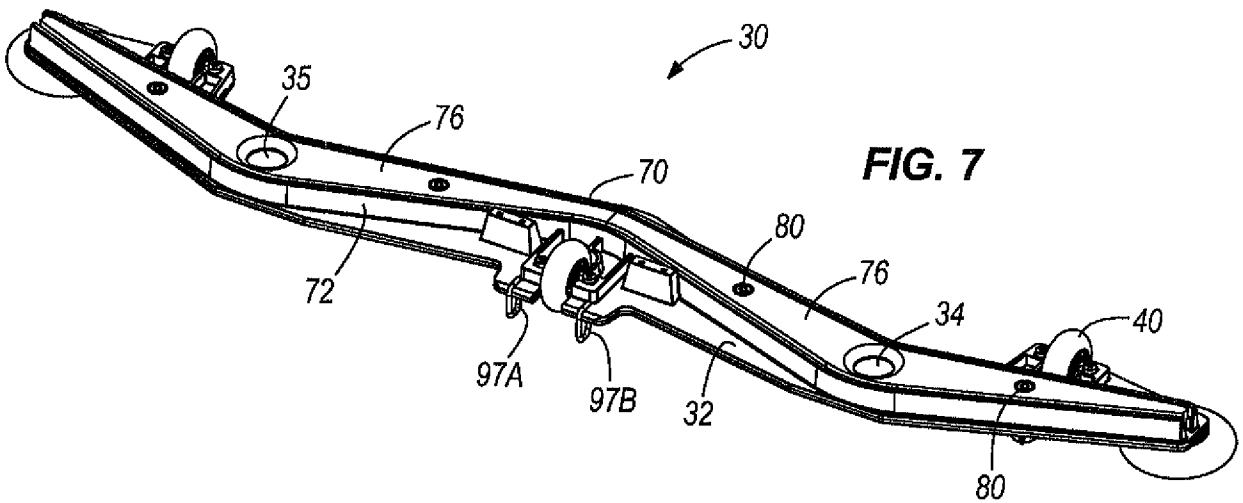
FIG. 7 is a bottom perspective view of a squeegee assembly embodying aspects of the present invention.
Figure 8:
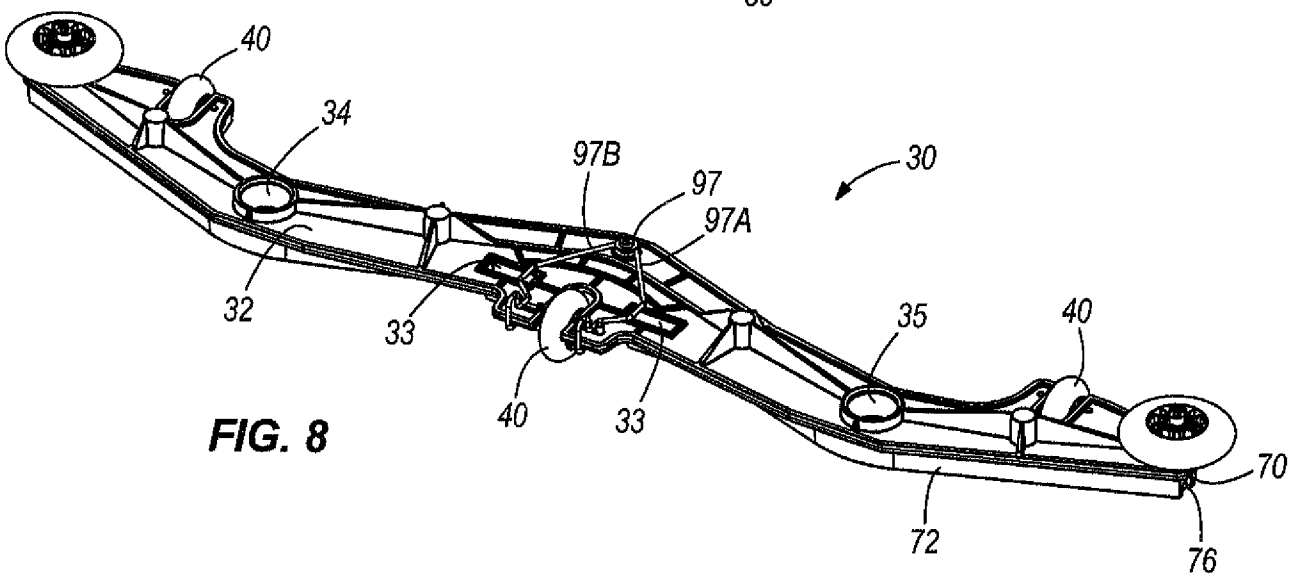
FIG. 8 is a top perspective view of a squeegee assembly shown in FIG. 7.
Figure 9:
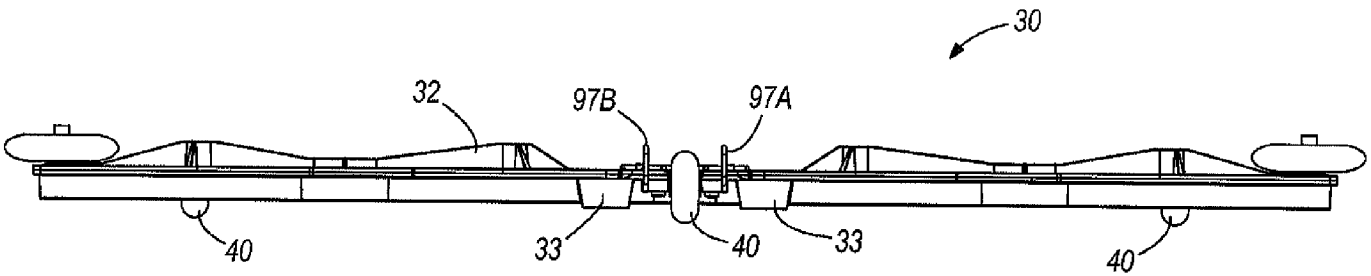
FIG. 9 is a rear elevation of the squeegee assembly shown in FIG. 7.
Figure 10:
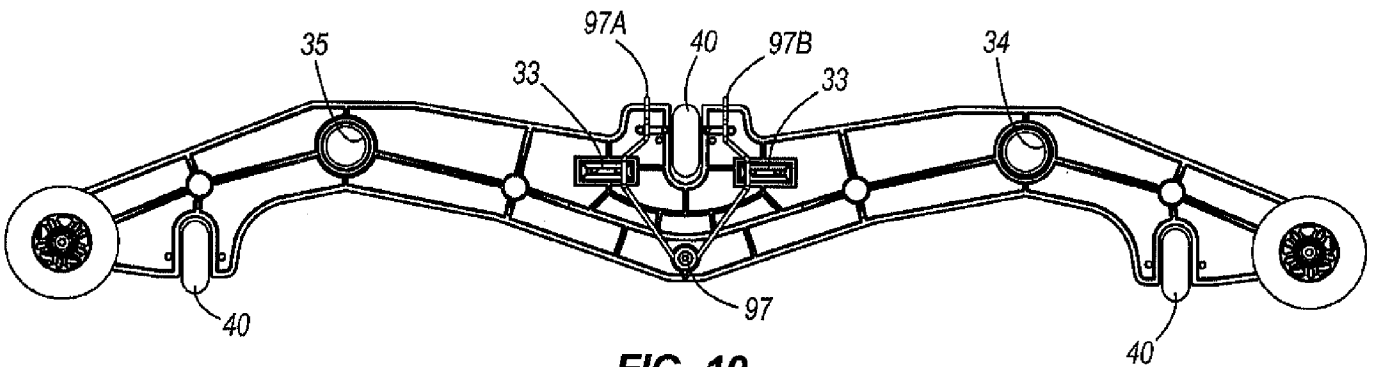
FIG. 10 is a top view of the squeegee assembly shown in FIG. 7.
Figure 12:
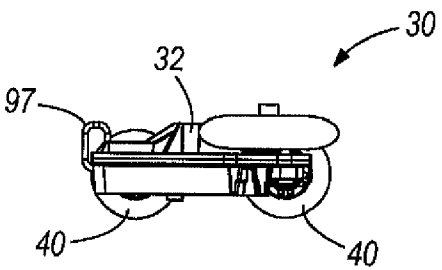
FIG. 12 is a right side view of the squeegee assembly shown in FIG. 7.
Figure 11:
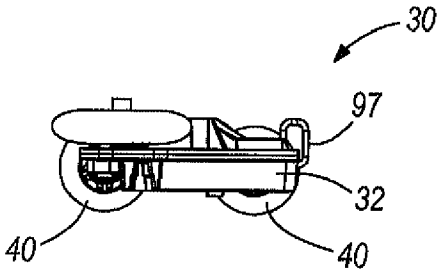
FIG. 11 is a left side view of the squeegee assembly shown in FIG. 7.
Figure 13:
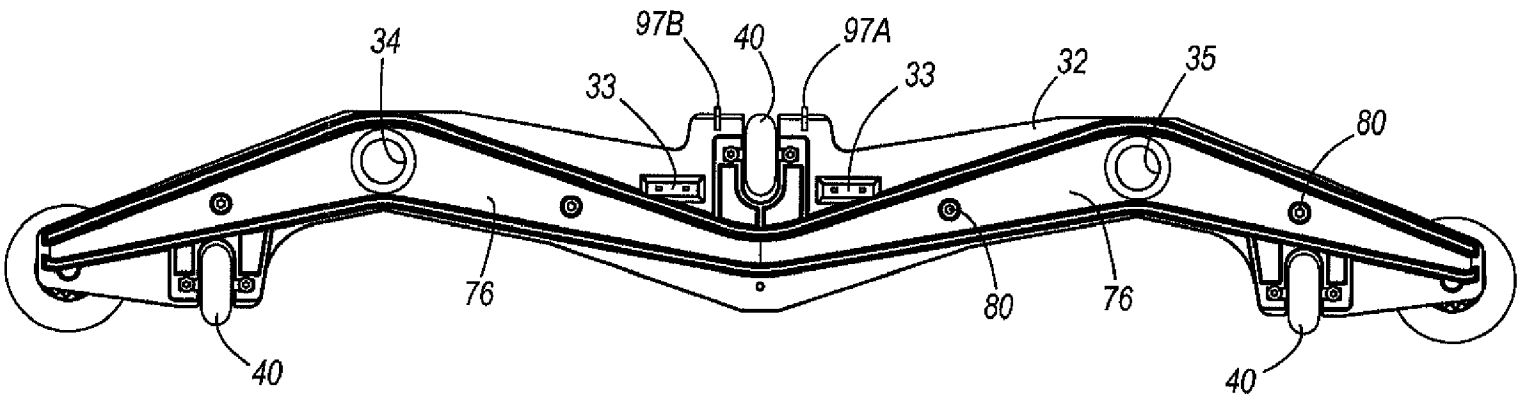
FIG. 13 is a bottom view of the squeegee assembly shown in FIG. 7.
Figure 14:
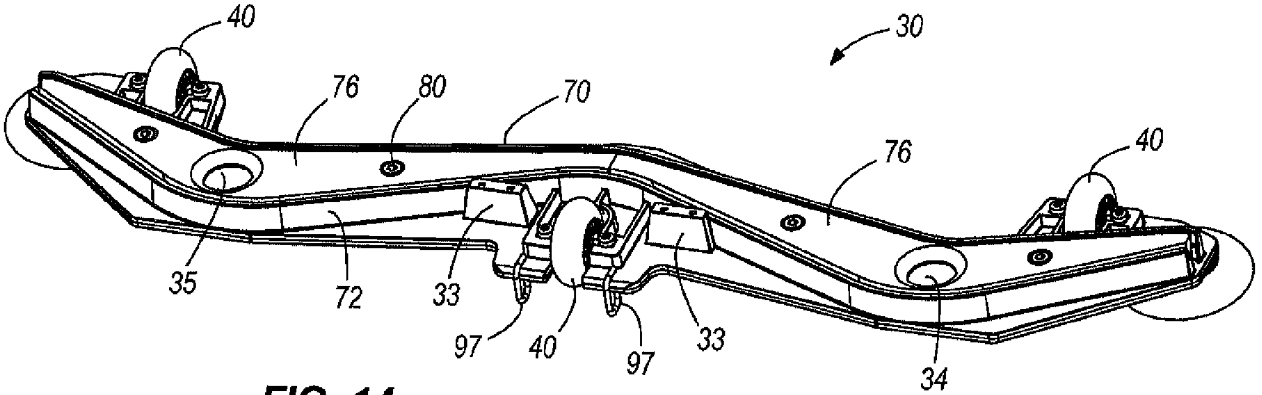
FIG. 14 is a bottom perspective view of a squeegee assembly embodying aspects of the present invention.
Figure 15:
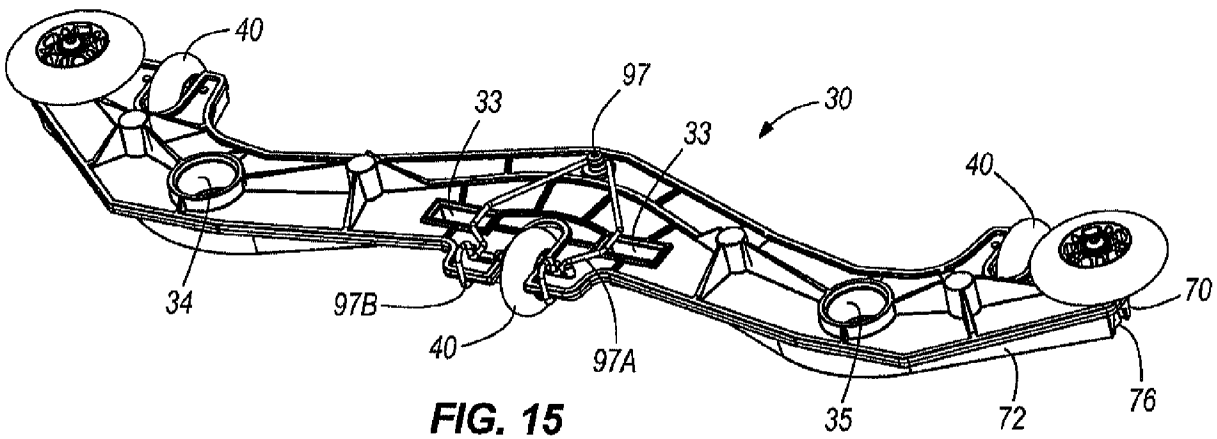
FIG. 15 is a top perspective view of a squeegee assembly shown in FIG. 14.
Figure 16:
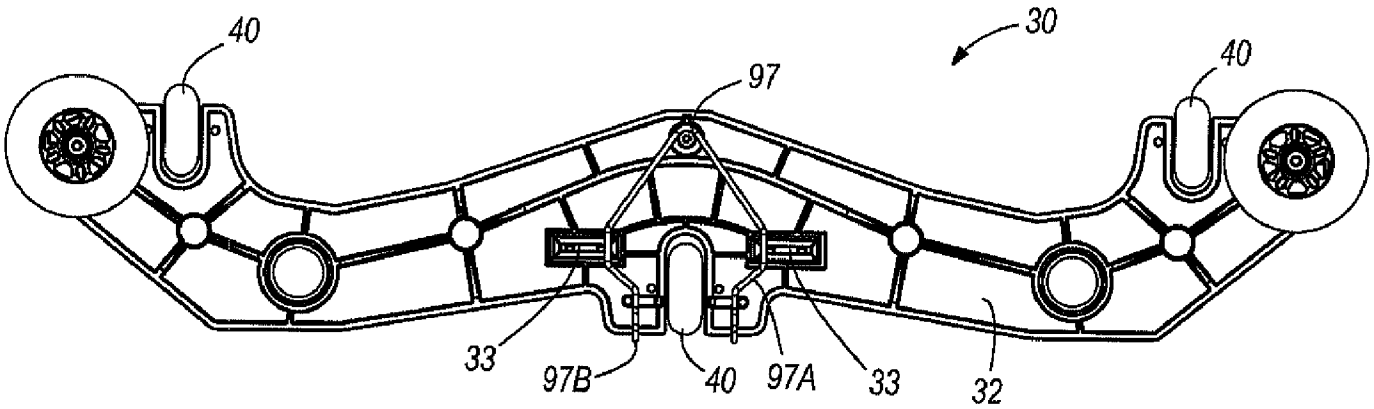
FIG. 16 is a top view of the squeegee assembly shown in FIG. 14.
Figure 17:
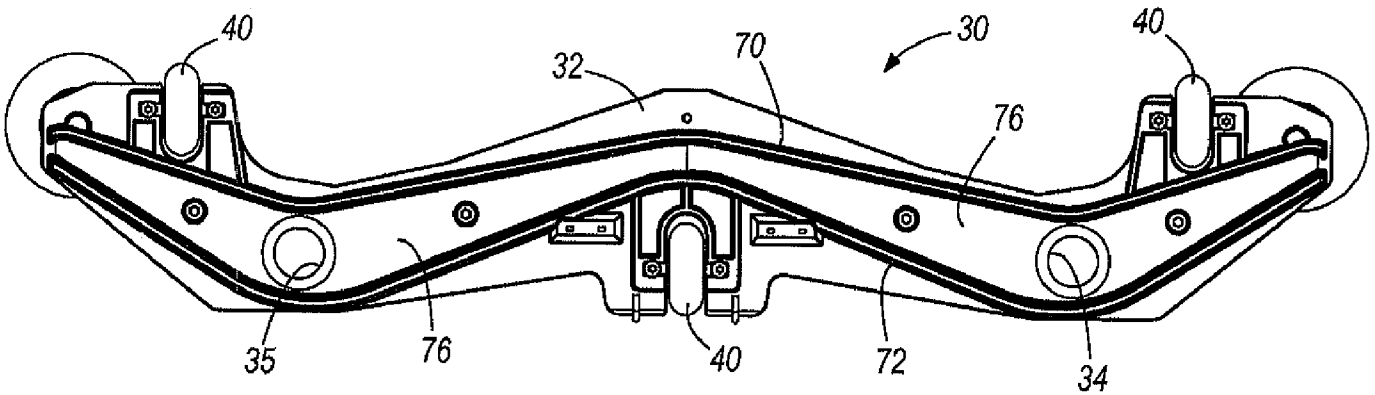
FIG. 17 is a bottom view of the squeegee assembly shown in FIG. 14.
Figure 19:
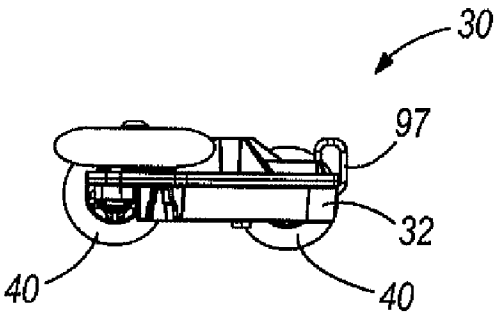
FIG. 19 is a left side view of the squeegee assembly shown in FIG. 14.
Figure 18:
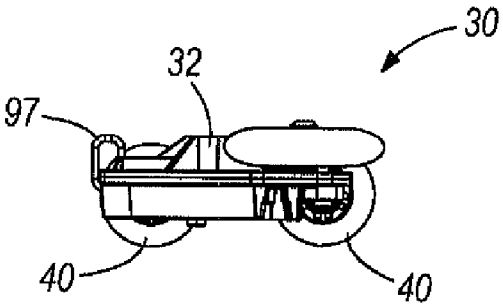
FIG. 18 is a right side view of the squeegee assembly shown in FIG. 14.
Figure 20:
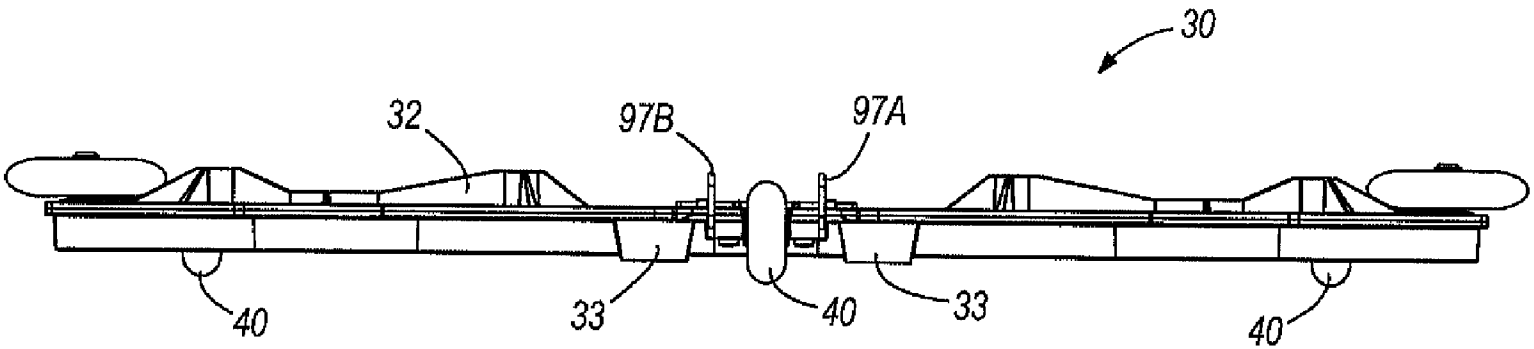
FIG. 20 is a rear elevation of the squeegee assembly shown in FIG. 14.
Figure 21B:
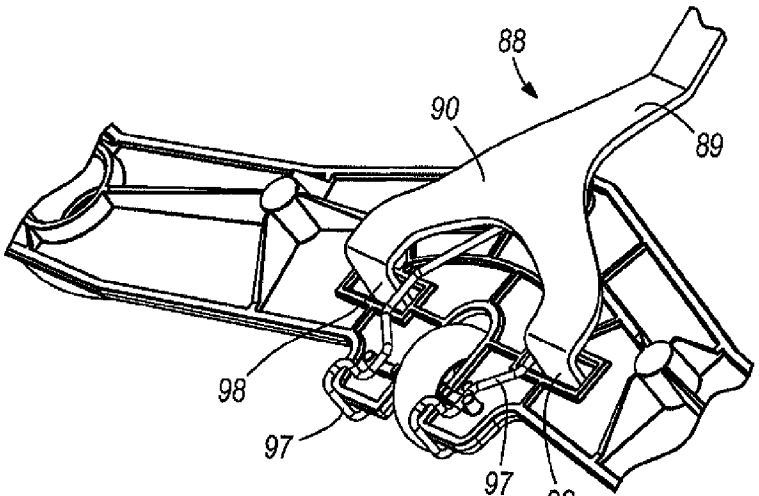
FIG. 21 is a top perspective view of a squeegee assembly and lifting mechanism embodying aspects of the present invention.
Figure 21A:
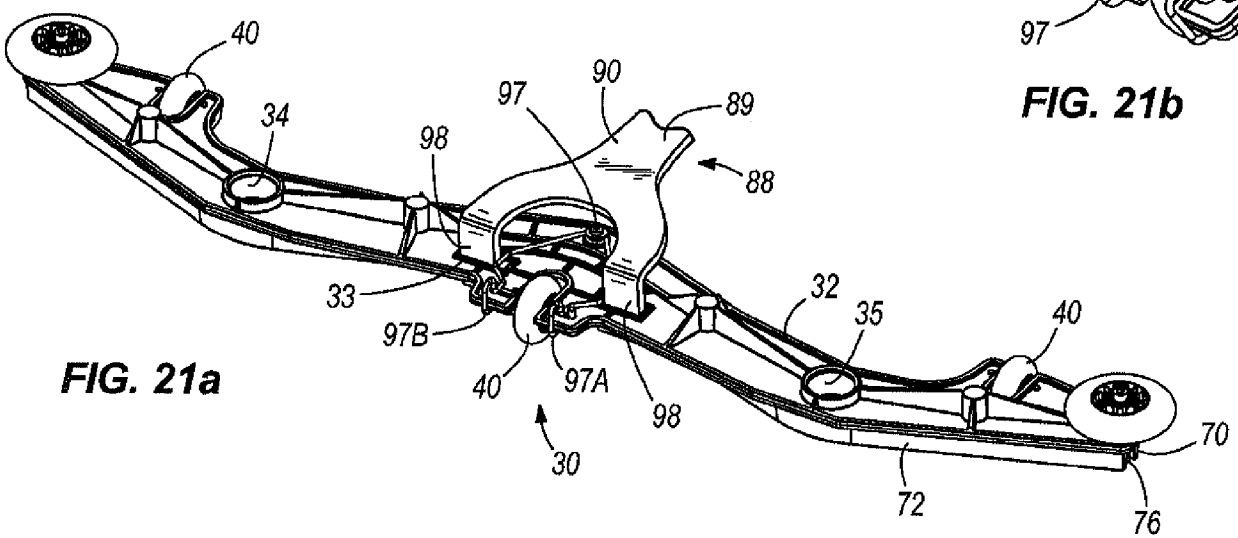
Figure 22:
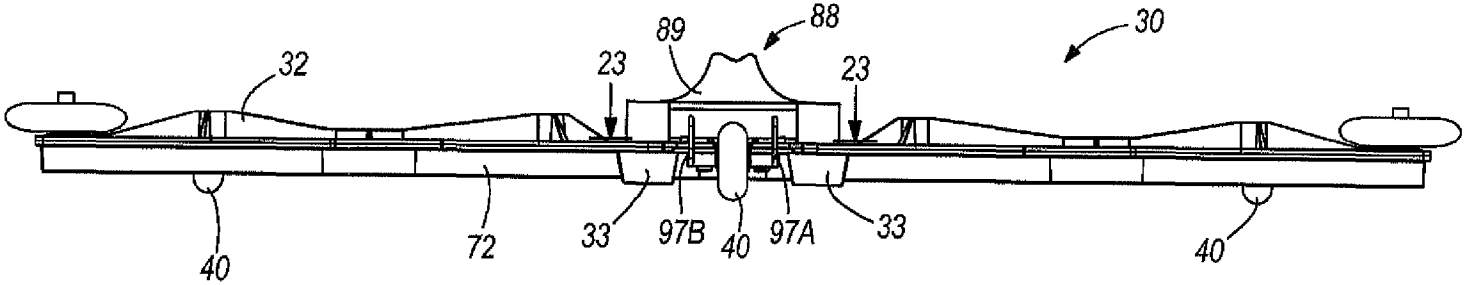
FIG. 22 is a rear elevation of the squeegee assembly and lifting mechanism shown in FIG. 21.
Figure 23:
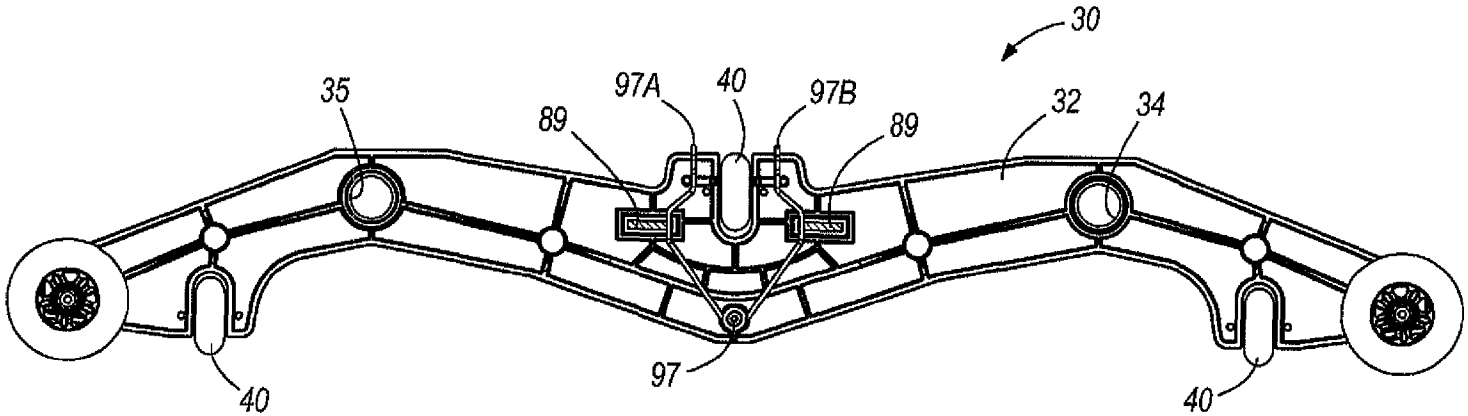
FIG. 23 is a top cross-sectional view of the squeegee assembly and lifting mechanism shown in FIG. 21, wherein the cross-section is taken along line 23-23 of FIG. 22 to show the bias member of the squeegee assembly received within the recesses of the lifting mechanism.

As specifically shown in FIGS. 4 and 5, the squeegee blades 36, 37 are coupled to the frame 32 via a trapping, wedging, jamming, squeezing, or pinching means. In other words, as shown in these figures, the blades are squeezed tightly between two surfaces or edges of the squeegee assembly 30. Specifically, the illustrated squeegee assembly 30 has a channel 66 for receiving and orienting the first and second squeegee blades 36, 37. The channel is at least partially defined by a base 68, a first wall 70 oriented at an angle relative to the base 68, and a second wall 72 offset from the first wall 70 and oriented at an angle relative to the base 68. More specifically, one of the walls 70 is positioned at an obtuse angle relative to the base 68, while the other wall 72 is positioned at an acute angle relative the to base 68, as measured from the same reference point. As such, the first wall 70 and the second wall 72 are oriented in a non-parallel manner in the illustrated embodiment. As illustrated, the first and second walls 70, 72 form a wedge-like configuration. In some embodiments, the first and second walls 70, 72 of the channel 66 have one or more steps, notches, or teeth 74. This profile can help secure the blades against unintentional movement when connected to the squeegee assembly 30.

A jam 76 is provided to couple the blades to the frame 32. The jam 76 is dimensioned and configured to be received within the channel 66 and pinch, squeeze, wedge, or trap the first and second squeegee blades 36, 37 against the first and second walls 70, 72 of the channel 66. In other words, the jam 76 has a substantially matching wedge shaped cross-section to the wedge shaped cross-section of the channel 66. Like the channel 66, the jam 76 has edges or walls 78, 79 that are angled. One wall 78 forms obtuse angle with respect to the base when coupled to the frame 32 and the opposite wall 79 forms an acute angle with respect to the base 68, with both angles being measured from the same reference. Accordingly, the opposite walls 78, 79 of the jam 76 that engage the sides of the blade 36, 37 are non-parallel. As shown in the figures, the jam 76 can have one or more steps, notches, or teeth 74 similar to the walls 70, 72 of the channel 66. More specifically, the sides or edges 78, 79 of the jam 76 have a stepped profile. This profile can help secure the blades 36, 37 against unintentional movement when connected to the squeegee assembly 30.

A plurality of fasteners 80 extend between the jam 76 and the channel 66 to couple the jam 76 to the channel 66. The fasteners 80 can be threaded fasteners or other fasteners known in the art. As illustrated in FIGS. 4 and 5, a bias member 81, such as a compression spring or other elastic member, can be positioned between the jam 76 and the base 68 of the channel to assist with separating the jam 76 from the channel 66 when desired. As illustrated, the bias member 81 rests within a recess positioned in both the channel 66 and in the jam 76.

Due to the configuration of the jam 76 and the channel 66, the blades 36, 37, when coupled to the frame 32, will be oriented at a non-right angle relative to the frame 32 and the floor. More specifically, the leading blade 36 is oriented at an obtuse angle relative to fluid encountered on the floor during normal operation and the trailing blade 37 is oriented at an acute angle relative to fluid encountered on the floor during normal operation. This illustrated configuration has been found to be advantageous to assist with removing liquid from the floor. Although the illustrated configuration places the leading and trailing blades 36, 37 in a non-parallel configuration, some embodiments may use a parallel configuration.

In operation, a leading and trailing squeegee 36, 37 are placed in the channel 66, wherein each squeegee has a first side 82 and a second side 83 bounded by top and bottom longitudinal edges 84, 85 and two vertically oriented side edges 86. Either the first or second sides 82, 83 of the blades 36, 37 are placed in abutment against the walls 70, 72 of the channel 66 and the top longitudinal edge 84 of each blade is placed in abutment with the base 68 of the frame 32. The jam 76 can then be forced into engagement with the blades 36, 37. The fasteners 80 cause the jam 76 to wedge, squeeze, trap, or pinch the blades 36, 37 between jam 76 and the walls 70, 72 of the channel 66. This secures the blades 36, 37 to the frame 32 and places them in a preferred orientation. Specifically, the blades 36, 37 are not parallel to each other. As shown in the figures, the stepped surfaces of the channel 66 and jam 76 cause the blades 36, 37 to deform, which further prevents disengagement of the blades from the frame 32.

To change the squeegee blade 36, 37, the fasteners 80 can be released and the jam 76 moved away from the base 68 of the channel 66. The jam 76 can be moved manually or under the force of the bias members 81. Once the jam 76 has moved a sufficient distance, the blades 36, 37 can be removed and replaced.

The embodiment illustrated and described above was with reference to a squeegee assembly 30 having two squeegee blades 36, 37. The same type of device can be used to secure a single squeegee blade to a squeegee assembly 30.

As mentioned above, the illustrated squeegee assembly 30 has two features that are used to orient the blades relative to the floor. One was the fixation device 38 described above. The other is a set of rollers 40 that always place the frame 32 and squeegee blades 36, 37 in the same orientation with respect to the floor. As illustrated, the three rollers 40 are coupled to the frame 32 and adapted to roll along a floor being traversed by the squeegee assembly 30. The rollers 40 are not all placed within a single line. Rather, at least one roller 40 is not aligned with the other two rollers 40. In other words, each roller 40 has an axis of rotation, and the axis of rotation of each roller 40 not intersecting both of the other two rollers 40. Since the rollers 40 form three points of contact that are non-linear, the rollers 40 define a plane. This plane determines the orientation of the frame 32 relative to the floor. In some embodiments, this plane can be altered by adjusting the rollers 40 on the frame 32 or by adding a different sized roller 40 in any of the roller positions.

In the illustrated embodiment, the frame 32 has a first and second end and a central area positioned between the first and second end. One roller 40 is positioned adjacent each end of the frame 32 and one roller 40 being positioned in the central area. Specifically, the centrally located roller 40 is positioned behind the upper apex 46 of the W-shape squeegee. More specifically, it is located within the wedge 56 defined by the upper apex of the W-shape squeegee. The rollers 40 positioned adjacent each end of the squeegee assembly 30 are positioned at least partially within the wedge 58, 60 defined by the two lower apexes 48, 50 of the W-shaped squeegee.

Figure 24:
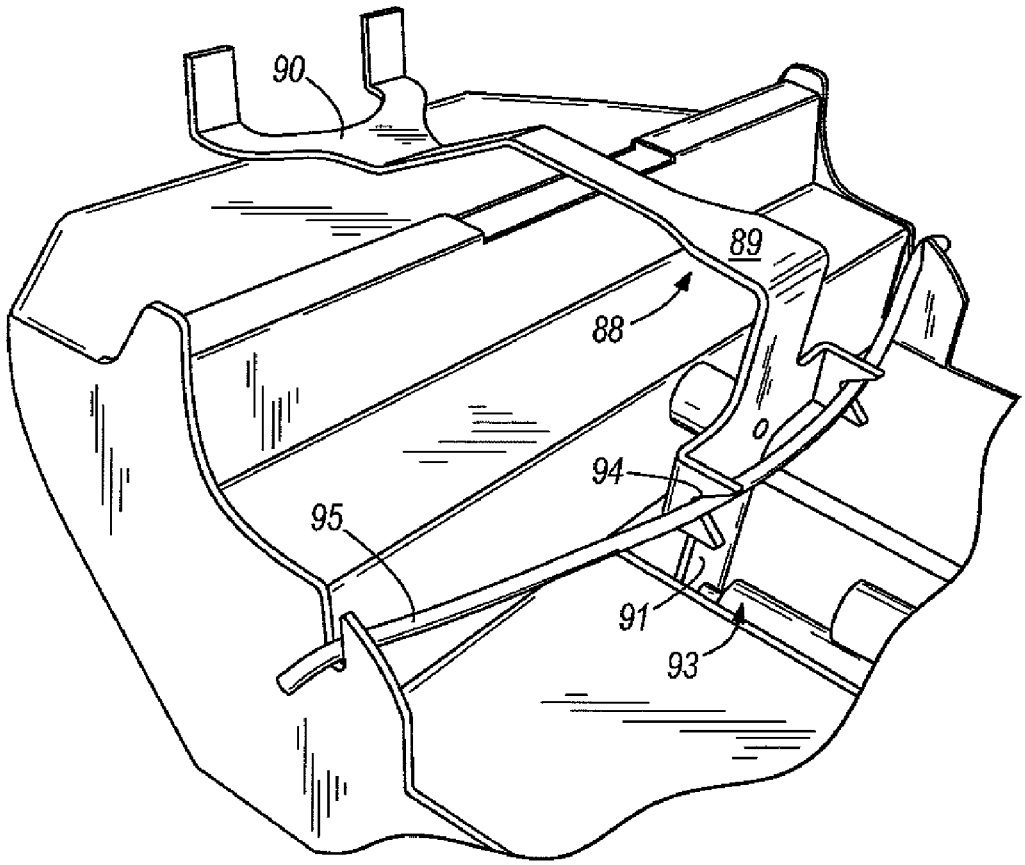
FIG. 24 is a bottom view of a lifting mechanism coupled to a floor cleaning machine.
Figure 25:
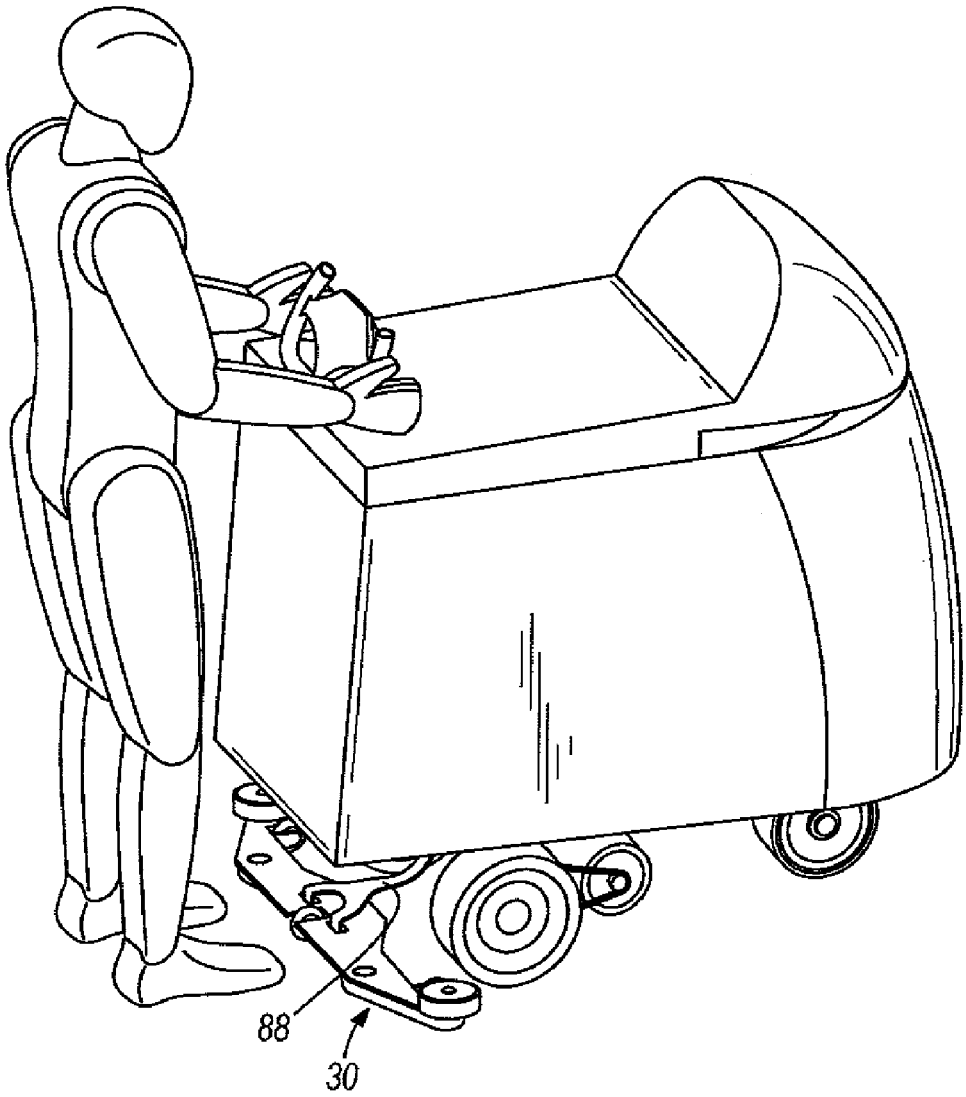
FIG. 25 is a rear perspective view of an exemplary floor cleaning machine having a squeegee assembly embodying aspects of the present invention.

As shown in FIGS. 21-24, a lifting device or member 88 can be coupled to the squeegee assembly 30 to selectively lift the squeegee assembly 30 off of the floor. Although a variety of known lifting devices 88 can be used to lift the squeegee assembly 30, only one particular device is illustrated. As shown in FIG. 24, the illustrated lifting device 88 operates on a fulcrum principle. In other words, the lifting device 88 is an elongated member 89, such as a metal beam or rod, that has a first end 90 and a second end 91 that are pivotable about a fulcrum 92. The first end 90 of the beam engages the squeegee assembly 30, while the second end 92 of the beam is acted upon by force providing device 93, such as a linear motor, hydraulic or pneumatic system, and the like. The fulcrum in the illustrated embodiment includes a bracket 94 coupled to the beam 89, wherein the bracket 94 accepts or is received upon a rod or other pivot 95. A rubber member 96 is also coupled to the fulcrum area. This rubber member 96 extends between the floor cleaning machine 42 and the beam 89.

In operation, the force providing device 93 is actuated to apply a force to the second end of the beam 89. This causes the beam 89 to move about the fulcrum or pivot point 92, 95, which ultimately lifts the squeegee assembly 30 off of the floor. The force applying device 93 can be actuated in the opposite direction to lower the squeegee assembly 30 back to the floor.

Although the lifting member 88 can be coupled to the squeegee assembly 30 many different ways, the illustrated embodiment only shows one particular type of connection. As illustrated, the frame 32 of the squeegee assembly 30 includes a set of apertures 33 and a biased member 97 coupled to the frame 32 adjacent the apertures 33. The biased member 97 is biased toward the apertures 33. The first end 90 of the lift member 88 can be positioned within the apertures 33 as shown. More specifically, the end 90 of the lifting member 88 has a fork-like configuration including a first fork member and a second fork member. The first and second fork members each are received within one of the apertures 33 of the frame 32. Further, the biased member 97 is positioned between the apertures of frame 32 and has two biased elements 97A, 97B, wherein one biased element is biased toward each aperture 33. The biased member 97 can be a type of torsion spring, wherein the coil is attached to the frame 32 and the two ends of the spring extend toward the apertures 33 to engage the end 90 of the lifting member 88. However, in other embodiments, the bias member can be other types of springs or elastic members.

The lifting member 88 has a recess 98 in each fork member of the end 90 positioned within the apertures 33. The recesses 98 are dimensioned and configured to receive the biased member 97, or more specifically, the ends or bias elements of the bias member. The biased member 97 is biased to engage the recesses 98 and couple the frame 32 to the lifting member 88. The biased member 97 is configured to disengage the recess and allow the frame 32 to separate from the lifting member when a predetermined force is applied to the frame 32.

In operation, the squeegee assembly 30 is coupled to a floor cleaning machine 42 as follows. The forked end 90 of the lifting member 88 is aligned with the apertures 33 on the squeegee assembly 30. The free ends 97A and 9713 of the bias member 97 on the squeegee assembly 30 are then pushed toward each other to move the free ends away from the center of the apertures 33. The forked end 90 of the lifting member 88 can be inserted into the apertures 33. The free or biased ends 97A, 97B of the biased member 97 can then be released to allow the free ends 97A, 97B to be biased toward the forked end 90 of the lifting member 88. The free ends of the bias member 97 can then engage the recesses 98 in the forked end to secure the lifting member to the squeegee assembly 30.

The squeegee assembly 30 can be separated from the lifting mechanism 88 as follows. The free ends of the bias member 97 can be pushed together to cause the free ends of the bias member 97 to disengage the recesses 98 on the forked end 90. As such, the forked end 90 of the lifting member 88 can be removed from the apertures 33 of the squeegee assembly 30.

Alternatively, the squeegee assembly 30 can be separated from the lifting mechanism 88 during operation of the floor cleaning machine 42 if the squeegee assembly 30 runs into an object with sufficient force. In such a situation, the forces applied to the squeegee assembly 30 by the object will cause the forked end 90 to separate from the apertures 33 of the squeegee assembly 30. Specifically, the applied force will cause a relative force between the lifting member 88 and the squeegee assembly 30. This relative force will overcome the bias force of the bias member 97 to cause the bias member to disengage the recesses 98 of the forked end 90.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, the connection between the lifting device 88 and the squeegee assembly 30 can be altered relative to the illustrated embodiment and yet fall within the spirit and scope of the present invention. In some alternative embodiments, the first end of the lifting member may not be forked. Accordingly, one or more bias members can engage recesses positioned on opposite sides of the first end of the lifting member to secure the lifting member to the squeegee assembly.

Additionally, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A squeegee assembly for removing liquids from a floor, the squeegee assembly adapted for use with a floor cleaning machine, the squeegee assembly comprising:

a frame movable in a direction of travel and having a first and a second suction port separated from each other in a lateral direction; and a squeegee blade coupled to the frame and positioned adjacent the suction ports relative to the direction of travel, wherein the squeegee blade has a first portion positioned adjacent the first suction port, the first portion extending in both lateral directions away from the first suction port at an angle to define a first funnel channeling substantially all fluid encountered by the first portion toward the first suction port, and wherein the squeegee blade has a second portion positioned adjacent the second suction port, the second portion extending in both lateral directions away from the second suction port at an angle to define a second funnel channeling substantially all fluid encountered by the second portion toward the second suction port.

2. The squeegee assembly of claim 1, wherein the first and second portions are integral to one another.

3. The squeegee assembly of claim 1, wherein the first and second suction ports are located on opposite sides of a center of the frame.

4. The squeegee assembly of claim 1, wherein the squeegee blade includes an opening to channel fluid toward at least one of the first suction port and the second suction port.

5. The squeegee assembly of claim 4, wherein the squeegee blade includes a first opening adjacent the first suction port, and a second opening adjacent the second suction port.

6. The squeegee assembly of claim 1, wherein each of the first portion and the second portion is defined by a concave portion.

7. The squeegee assembly of claim 6, wherein each of the concave portions is defined by a respective V-shape of the squeegee blade.

8. The squeegee assembly of claim 1, wherein the squeegee blade includes a leading squeegee blade and a trailing squeegee blade offset from the leading squeegee blade in the direction of travel.

9. The squeegee assembly of claim 8, wherein the leading squeegee blade includes a first opening to channel fluid to the first suction port and a second opening to channel fluid to the second suction port.

10. The squeegee assembly of claim 1, wherein the first and second funnels are immediately adjacent one another.

11. A method of removing a liquid from a floor, the method comprising:

providing a frame movable in a direction of travel and having a first suction port and a second suction port separated from the first suction port in a lateral direction with respect to the direction of travel, and a squeegee blade contactable with the floor;

separating liquid encountered by the squeegee blade into first and second portions by the squeegee blade;

funneling the first portion of liquid toward the first suction port; and funneling the second portion of liquid toward the second suction port.

12. The method of claim 11, wherein separating the liquid comprises separating the liquid with a portion of the squeegee blade extending forwardly in the direction of travel of the frame.

13. The method of claim 11, further comprising channeling substantially all liquid encountered by a first portion of the squeegee blade toward the first suction port; and channeling substantially all liquid encountered by a second portion of the squeegee blade toward the second suction port.

14. The method of claim 13, wherein each of the first portion and the second portion is defined by a V-shape, the method further comprising:

driving liquid encountered by each of the first portion and the second portion toward an apex of the corresponding V-shape; and removing the liquid at the apex of the V-shape with suction.

15. The method of claim 11, wherein the squeegee blade is a first squeegee blade, the method further comprising receiving liquid past the first squeegee blade to an area between the first squeegee blade and a second squeegee blade spaced a distance behind the first squeegee blade with respect to the direction of travel.

16. The method of claim 15, channeling liquid to the first suction port and the second suction port via the second squeegee blade.

17. The method of claim 15, wherein at least one of the first and second suction ports is located between the first and second squeegee blades.

18. The method of claim 11, further comprising passing the first portion of liquid through an aperture in the squeegee blade.

19. The method of claim 18, further comprising passing the second portion of liquid through another aperture in the squeegee blade.

20. The method of claim 19, wherein the first and second suction ports are both located behind the squeegee blade with respect to the direction of travel.

* * * * *